US005668827A

United States Patent [19]

Goy

[11] Patent Number: 5,668,827

[45] Date of Patent: Sep. 16, 1997

[54] CRUCIBLE FOR INDUCTION MELTING

[75] Inventor: Wilfried Goy, Kelsterbach, Germany

[73] Assignee: Ald Vacuum Technologies GmbH, Erlensee, Germany

[21] Appl. No.: 506,839

[22] Filed: Jul. 25, 1995

[30] Foreign Application Priority Data

Aug. 18, 1994 [DE] Germany ..... 44 29 340.2

[51] Int. Cl.[6] ..... H05B 6/22

[52] U.S. Cl. ..... 373/156; 373/158

[58] Field of Search ..... 373/146, 151, 373/155, 156, 158

[56] References Cited

U.S. PATENT DOCUMENTS

| | | | |
|---|---|---|---|
| 3,461,215 | 8/1969 | Reboux | 13/27 |
| 3,709,678 | 1/1973 | Helary et al. | 75/10 R |
| 4,432,093 | 2/1984 | Reboux | 373/157 |
| 4,738,713 | 4/1988 | Stickle et al. | 75/10.18 |
| 4,873,698 | 10/1989 | Boen | 373/156 |
| 5,058,127 | 10/1991 | Barnier et al. | 373/157 |
| 5,109,389 | 4/1992 | Stenzel | 373/156 |
| 5,283,805 | 2/1994 | Kawano et al. | 373/156 |

FOREIGN PATENT DOCUMENTS

| | | |
|---|---|---|
| 518499 | 1/1931 | Germany . |
| 4209964 | 9/1993 | Germany . |

*Primary Examiner*—Tu B. Hoang
*Attorney, Agent, or Firm*—Felfe & Lynch

[57] ABSTRACT

At least three palisades are set up vertically and parallel to each other, spaced apart, and distributed around the arc of a circle in such a way as to surround the melt. A circular, plate-shaped part forms the bottom of the crucible and supports the palisades, the palisades being provided at least in part with cavities through which a coolant flows, and with an induction coil, which is wound around the outside of the palisades a certain distance away and carries an alternating current. At least two groups of palisades are connected to each other by means of an electrically conductive bar or pipe socket, each palisade group or each individual palisade being electrically insulated with respect to adjacent palisade groups or individual palisades.

3 Claims, 2 Drawing Sheets

CRUCIBLE FOR INDUCTION MELTING

BACKGROUND OF THE INVENTION

The invention pertains to a crucible for the induction melting or super heating of metals, alloys, or other electrically conductive materials with at least three palisades, which are set up vertically and parallel to each other a certain distance apart and distributed around an arc of a circle in such a way as to surround the melt; with a part in the form of a circular plate, which forms the bottom of the crucible and supports the palisades, the palisades being provided at least in part with cavities, through which a coolant flows; and with an induction coil, which is wound around the outside of the palisades a certain distance away and which carries an alternating current.

A process for the melting of difficult-to-melt metals, especially tantalum, tungsten, thorium, and alloys of these metals in a water-cooled container is known (DE 518 499), the container consisting in this case of materials such as quartz glass, copper, or silver, which melt at temperatures that are lower than the melting point of the material to be melted. The means used to supply the energy required for melting and the means used to cool the container are devised in such a way that the material to be melted is melted completely without being contaminated by the crucible material. The crucible itself can be heated by means of an induction coil. The crucible is built up of individual segments, which are separated from each other by an insulating layer of, for example, mica, to prevent the current in the crucible from circling all the way around.

U.S. Pat. No. 3,461,215 discloses a induction crucible which is assembled from a plurality of palisades, all of which are arranged vertically and parallel to each other on a circular bottom plate to form a hollow cylinder. Cooling water flows through all of the electrically and thermally conductive palisades, which are also surrounded by an induction coil. The bottom plate of ceramic material is provided with a plug, through which the melt can be withdrawn. Strips of insulating material are inserted between the palisades.

U.S. Pat. No. 4,738,713 discloses a crucible for the slagless melting of high-purity reactive metals in a vacuum chamber, in which cooling water flows through the palisades, which are surrounded by the induction coil and which are screwed tightly to a circular bottom plate. The tubular palisades are separated from each other by slots, but all of them are in electrical contact with each other by way of the bottom plate, which is made of metal.

The known crucibles Suffer from the disadvantage of comparatively poor thermal efficiency. Thus the attempt was made to reduce the amount of heat lost by the Cooled palisades by adding insulating material to the melt, but this led in turn to a certain, although only slight, contamination of the melt (Schippereit et al.). Even this slight contamination of the melt material, however, is undesirable in many modern applications, and therefore this process has been accepted by industry to only a limited extent.

The arrangement and design of the palisades themselves and their electrical connection to each other or their insulation from each other have already been the object of numerous investigations. U.S. Pat. No. 3,223,519, for example, describes crucible segments which are insulated from each other, whereas in the case of the crucible according to U.S. Pat. No. 4,738,713, the palisades are set up a certain distance apart and connected to each other electrically.

SUMMARY OF THE INVENTION

The present invention is based on the task of creating a crucible of the type in question which does not require any insulating slag material and in which the energy losses caused by the electrical connection of all the palisades to each other are reduced.

According to the invention, this task is accomplished in that at least two of a plurality of palisades are connected to each other byway of a current-conducting bar or pipe socket or some other type of conductive connection to form a group of palisades, each of these groups of palisades being electrically insulated with respect to the adjacent groups of palisades.

DETAILED DESCRIPTION OF THE PREFERRED EMBODIMENT

Figure 1:
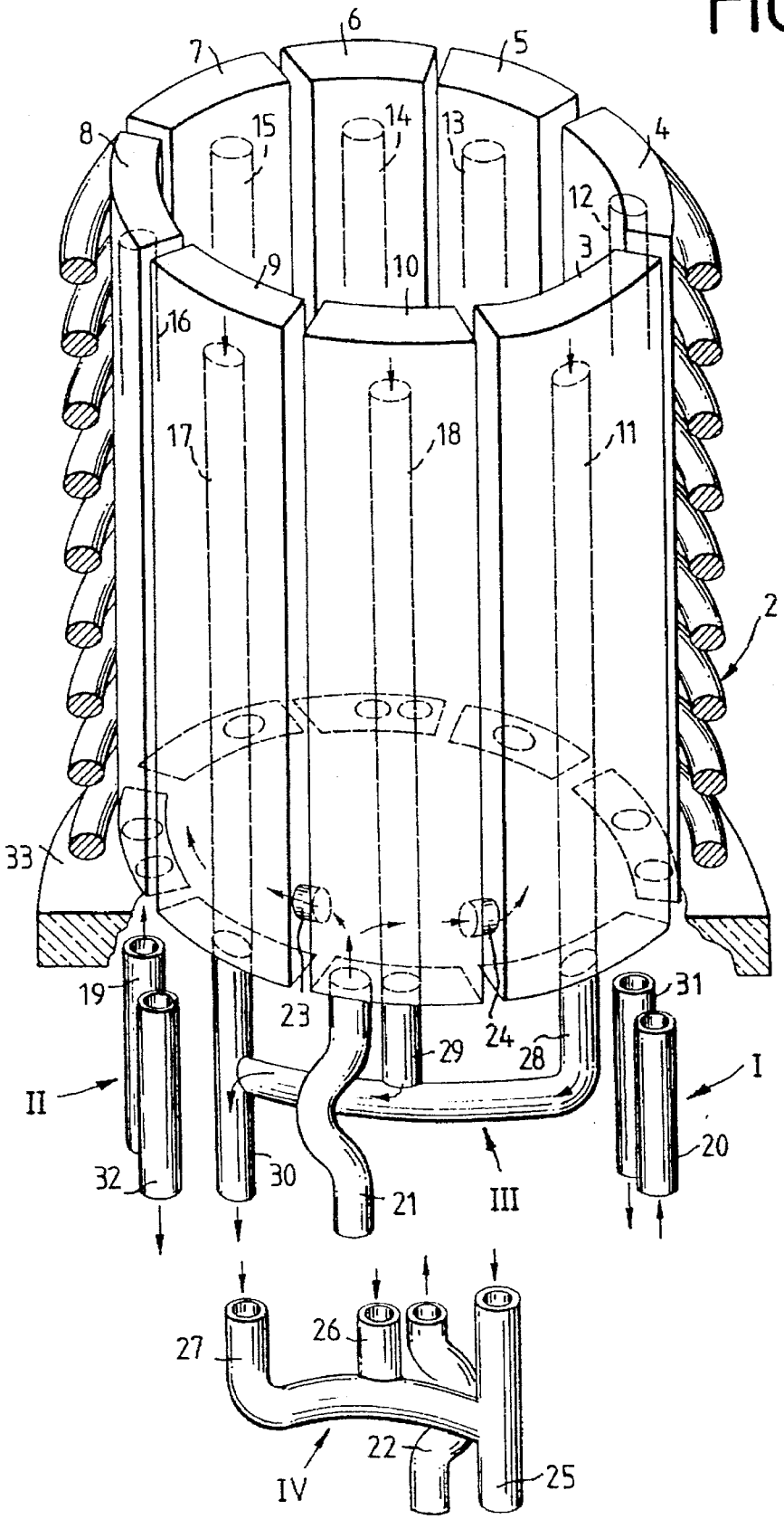
FIG. 1 is a schematic perspective, in perspective, of a crucible according to the invention.
Figure 2:
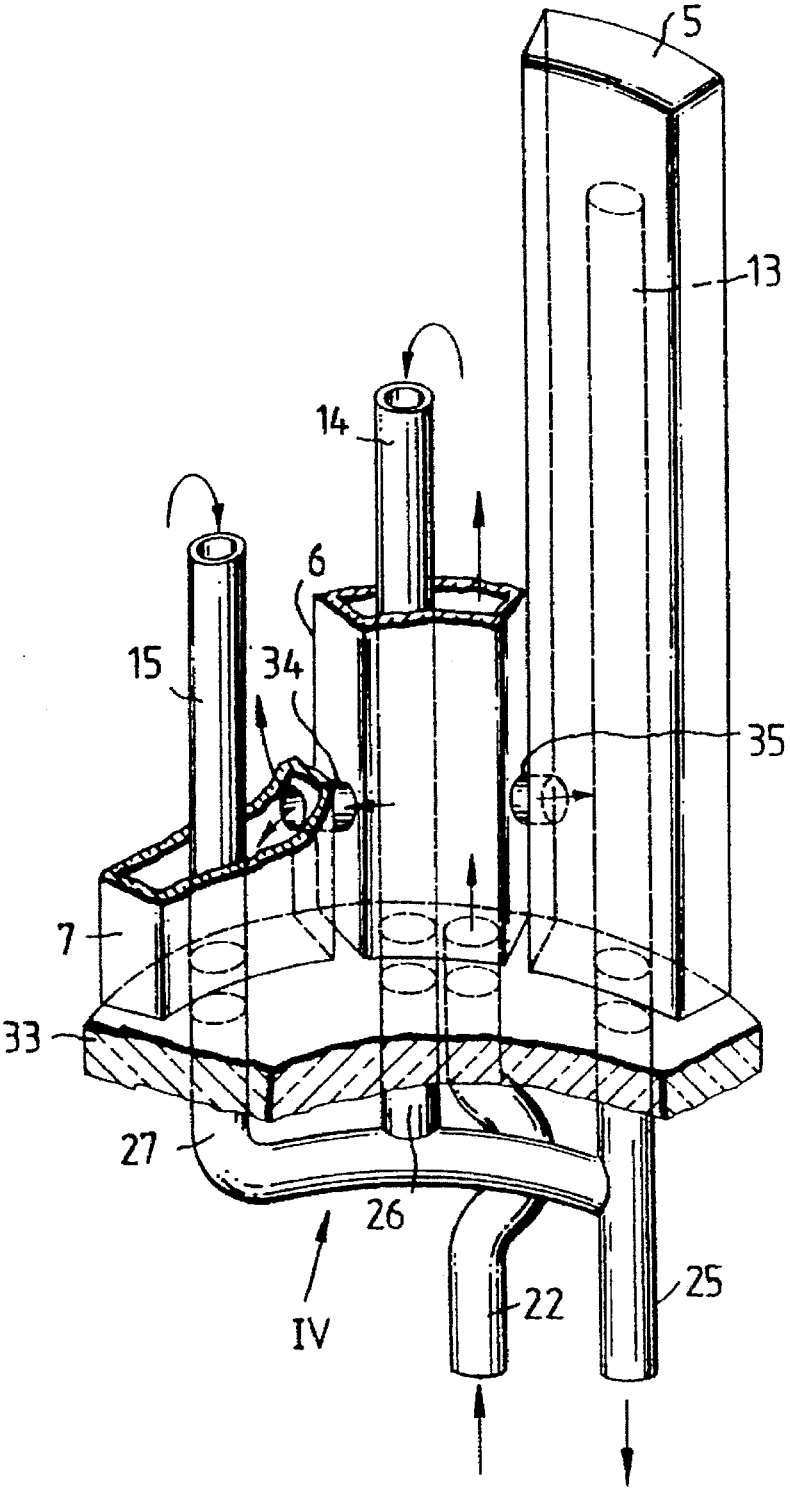
FIG. 2 is a cutaway schematic of a palisade group formed by three palisades.

The crucible consists overall of eight palisades 3–10, which are designed as hollow, tubular elements. A pipe 11–18 passes through each of the palisades in the longitudinal direction, with the result that the heated cooling water present in the cavity inside each palisade can flow down and out through these pipes. The cavity inside each palisade 3–10 communicates, furthermore, with a coolant inlet, which is formed by a total of four pipes 19, 20, 21, 22. Whereas each of the free-standing palisades 4, 8 has its own feed pipe 19, 20, palisades 3, 9, 10 are connected as a group to one feed pipe 21, and palisades 5, 6, 7 are connected as a group to another feed pipe 22. Each of the two groups of palisades 3, 9, 10 and 5, 6, 7 are connected among themselves by a pair of pipe sockets 23, 24 (for the sake of clarity, FIG. 1 shows only one pair of these pipe sockets). As the drawing shows, the feed and discharge connections 22, 25 of the rear group of palisades 5, 6, 7 are shown under the rest of the drawing in a detached manner, which makes it easier to see that, in addition to a single feed pipe 22 for palisade 6, three discharge pipes 25, 26, 27 are provided, each of which is assigned to its own palisade 5, 6, 7. In the arrangement of palisade group 3, 9, 10 shown in FIG. 1, discharge pipes 28, 29, 30 are connected to each other, so that the departing coolant can be sent via pipe 30 to the recooling unit.

Because all of palisades 3–10 are mounted on an insulator plate 33 (only part of which is shown) and all the cooling water discharge pipes are metal pipes, four different electrical circuits I–IV are produced in all. As the drawing also shows, palisades 3–10 are surrounded by an induction coil 2, which is shown in cross section.. The way in which this coil is designed and how it functions are well known to the expert and therefore do not have to be described in detail here.

In contrast to the known systems, the crucible described above offers the advantage, first, that it is possible to dispense with insulating slag material and, second, that, in the area under the influence of the magnetic field around the periphery of the crucible, there is no closed circuit for the flow of induced eddy currents, because the palisades are not all connected electrically to each other. The interconnection of all the palisades, regardless of whether this would be on the external or internal periphery or in the form of a bar attached to them, either at the top or at the bottom, represents a short-circuit ring, in which significant heat losses occur. These losses would thus be responsible for a deterioration in the electrical and thermal efficiency. If the short-circuit ring is on the bottom of the crucible or at the level of the bottom, it is possible to introduce only a small amount of melting power into the lower area of the melt, because the palisade short circuit displaces the electromagnetic field from the interior of the crucible.

If metallic and therefore electrically conductive interconnections between the crucible segments are eliminated entirely, a melting crucible consisting of vertically arranged palisades will suffer from strength problems. That is, the palisades will bend under the effects of alternating thermal loads. This becomes evident as a tangential twisting of the palisades and also as an increase in the diameter of the crucible, which is attributable to an expansion of the intermediate spaces between the palisades. In high performance applications of segmented crucible systems, such as in the case of systems for guiding or focusing the stream of metal being cast, this problem quickly makes the crucible unusable.

In the case of the crucible described above, only certain palisades are connected electrically to each other, thus eliminating the disadvantages of a completely closed short-circuit ring. The mutual stabilization of the electrically interconnected palisades considerably increases the stability of a crucible segment system and thus prolongs the service life of these systems.

Crucible palisades without additional stabilization experience especially severe loads when the melt flows over the top of them, such as in the case of tilting crucibles. The solution, namely, to install a closed metal ring on the palisades, leads to the above-described disadvantage of a loss of power, which can even lead to the partial solidification of the melt. The present invention provides for the partial connection of individual crucible segments or of especially stressed segments. Individual palisades are formed into palisade groups by the electrical connections between them. In terms of field theory, each gap or space between the individual connecting elements brings about an increase in the power converted in the melt.

The present crucible makes it possible to limit the occurrence of minor field attenuations only to the points where the palisades are exposed to especially severe loads. In the area where the palisades are not interconnected, the magnetic field can be directed almost without attenuation into the conductive melt. The heating power required for melting or superheating, furthermore, is introduced almost without attenuation into the material to be heated.

I claim:

1. Crucible for melting electrically conductive materials, said crucible comprising a plurality of upright spaced apart metal palisades arranged in parallel to form a circumferential wall, said palisades being provided with coolant cavities, an insulating base supporting said palisades, and conductive connecting means connecting at least two palisades to form at least two groups of electrically connected palisades, each group being electrically insulated from each other group and circumferentially separated from each other group by a single palisade for each group, said single palisades being electrically insulated from said groups.

2. Crucible as in claim 1 wherein said conductive connecting means comprises pipe means for transferring coolant between cavities of adjacent palisades.

3. Crucible as in claim 1 wherein said single palisades are electrically insulated from each other.

* * * * *